US008919741B2

(12) United States Patent
Sadinsky et al.

(10) Patent No.: US 8,919,741 B2
(45) **Date of Patent: *Dec. 30, 2014**

(54) FENCE AND FENCE BASE

(71) Applicant: Guardian Pool Fence Systems, Inc., Van Nuys, CA (US)

(72) Inventors: Steven E. Sadinsky, Van Nuys, CA (US); Thomas J. Farinola, Van Nuys, CA (US); Stuart B. Long, Camarillo, CA (US)

(73) Assignee: Guardian Pool Systems, Inc., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/076,077

(22) Filed: Nov. 8, 2013

(65) Prior Publication Data

US 2014/0061562 A1 Mar. 6, 2014

Related U.S. Application Data

(63) Continuation of application No. 12/763,873, filed on Apr. 20, 2010, now Pat. No. 8,579,262.

(51) Int. Cl.

| | |
|---|---|
| ***E04H 12/22*** | (2006.01) |
| ***E04H 17/22*** | (2006.01) |
| ***E04H 17/16*** | (2006.01) |

(52) U.S. Cl.

CPC ..... *E04H 17/22* (2013.01); *E04H 17/163* (2013.01)

USPC ..... 256/26; 256/65.14; 4/506

(58) Field of Classification Search

USPC ..... 256/24–27, 65.14, 73; 4/506; 404/6

See application file for complete search history.

(56) References Cited

U.S. PATENT DOCUMENTS

| | | | |
|---|---|---|---|
| 3,500,593 | A | 3/1970 | Kwake |
| 3,709,489 | A | 1/1973 | Holleran et al. |
| 4,143,857 | A | 3/1979 | Weiner |
| 4,681,302 | A | 7/1987 | Thompson |
| 5,011,325 | A | 4/1991 | Antonioli |

(Continued)

FOREIGN PATENT DOCUMENTS

| | | |
|---|---|---|
| JP | 08-199865 | 8/1996 |
| WO | WO 98/31899 | 7/1998 |
| WO | WO 01/12924 A1 | 2/2001 |

OTHER PUBLICATIONS

Patent Abstracts of Japan, Publication No. 08-199865; dated Aug. 8, 1996, 2008 in the name of Masatoshi Nishikawa.

*Primary Examiner* — Joshua Kennedy

(74) *Attorney, Agent, or Firm* — Christie, Parker & Hale, LLP

(57) ABSTRACT

A fence includes a plurality of bases, each base having a body having a floor, a top wall, side walls and end walls defining an interior chamber; a first projection extending from one of the end walls and having a top wall; and a second projection extending from another one of the end walls and having a bottom wall; wherein the bottom wall of the second projection and the top wall of the first projection are both configured to receive a pole and wherein the first projection of a first base of the bases can overlap the second projection of a second base of the bases when the floor of the first and second bases are resting on a common surface. The fence further includes a plurality of poles, each inserted into and maintained erect by one of the bases; and a mesh fencing material tensioned between the poles.

12 Claims, 9 Drawing Sheets

(56) References Cited

U.S. PATENT DOCUMENTS

| | | | |
|---|---|---|---|
| 5,020,764 | A | 6/1991 | Yamamoto |
| 5,123,773 | A | 6/1992 | Yodock |
| 5,186,438 | A | 2/1993 | Cross et al. |
| 5,231,807 | A | 8/1993 | Aymes |
| 5,402,999 | A | 4/1995 | Keehn, Sr. |
| 5,452,963 | A | 9/1995 | Christensen |
| 5,460,353 | A | 10/1995 | Rittenhouse |
| 5,611,641 | A | 3/1997 | Christensen |
| 5,639,179 | A | 6/1997 | Jensen |
| 5,664,769 | A | 9/1997 | Sadinsky et al. |
| 5,813,662 | A | 9/1998 | Langkruis |
| D400,264 | S | 10/1998 | Striefel et al. |
| 5,836,714 | A | 11/1998 | Christensen |
| 5,875,500 | A | 3/1999 | Shaanan et al. |
| 5,988,934 | A | 11/1999 | Wasserstrom |
| 5,993,103 | A | 11/1999 | Christensen |
| 6,004,218 | A | 12/1999 | Keating et al. |
| 6,086,285 | A | 7/2000 | Christensen |
| 6,203,242 | B1 | 3/2001 | Englund |
| 6,257,559 | B1 | 7/2001 | Mouri |
| 6,412,122 | B1 | 7/2002 | Foy et al. |
| D462,126 | S | 8/2002 | Englund |
| 6,676,113 | B2 | 1/2004 | Christensen et al. |
| 6,837,647 | B2 | 1/2005 | Tagg |
| D519,646 | S | 4/2006 | Wilmotte |
| D533,281 | S | 12/2006 | Christensen et al. |
| D546,969 | S | 7/2007 | Christensen |
| D552,250 | S | 10/2007 | Christensen et al. |
| 7,275,888 | B1 | 10/2007 | Christensen et al. |
| D555,804 | S | 11/2007 | Christensen |
| D569,992 | S | 5/2008 | Christensen et al. |
| 7,540,682 | B1 | 6/2009 | Christensen et al. |
| D599,488 | S | 9/2009 | Christensen et al. |
| 7,588,387 | B1 | 9/2009 | Christensen et al. |
| 2003/0219308 | A1 | 11/2003 | Boulais et al. |
| 2005/0184281 | A1 | 8/2005 | Bryan |
| 2006/0231821 | A1 | 10/2006 | Gavin |
| 2007/0098490 | A1 | 5/2007 | Christensen |
| 2007/0206990 | A1 | 9/2007 | Yodock, III et al. |
| 2009/0001334 | A1 | 1/2009 | Christensen et al. |
| 2009/0003931 | A1 | 1/2009 | Christensen et al. |
| 2009/0278103 | A1 | 11/2009 | Christensen et al. |

26
28
30
39
52
20
37
50
38
34
24
16
22
32
44
36
46
18
12

FENCE AND FENCE BASE

CROSS-REFERENCE TO RELATED APPLICATIONS

This application is a continuation of U.S. patent application Ser. No. 12/763,873, filed on Apr. 20, 2010, will issue as U.S. Pat. No. 8,579,262 on Nov. 12, 2013, the entire content of which is incorporated in its entirety herein by reference.

FIELD

Embodiments of the present invention relate to a fence and a fence base, and more particularly, to a stand-alone pool fence and a base to support such a fence.

DESCRIPTION OF THE RELATED ART

A safety structure, such as a fence, is often erected around a swimming pool in order to prevent a person, for example, an unsupervised child, from entering the pool area and accidentally falling into the pool. Often, the fence will include a gate that allows swimmers to enter the fenced area without having to remove the entire fence. Additionally, such fences typically include fence poles and gate poles that form a support structure for the fence and are adapted to maintain a fence material, such as nylon mesh, tensioned between the poles.

In order to erect the fence, the fence and gate poles are usually maintained upright by being inserted into holes or sockets in a pool deck surrounding the pool. As such, the sockets must be drilled or otherwise created in the pool deck to install the fence, and such sockets may not only be unsightly and expensive, but may also permanently alter the pool deck. Further, additional holes would have to be drilled into the pool deck in order to change the configuration of the pool fence.

SUMMARY

According to one embodiment of the present invention, a fence is provided including a plurality of bases, each base having a body having a floor, a top wall, side walls and end walls defining an interior chamber; a first projection extending from one of the end walls and having a top wall; and a second projection extending from another one of the end walls and having a bottom wall; wherein the bottom wall of the second projection and the top wall of the first projection are both configured to receive a pole and wherein the first projection of a first base of the bases can overlap the second projection of a second base of the bases when the floor of the first and second bases are resting on a common surface; a plurality of poles, each of the poles inserted into and maintained erect by one of the bases; and a fencing material tensioned between the poles.

In one embodiment, the bottom wall of the second projection and the top wall of the first projection are substantially co-planar, the first projection may further include a bottom wall that is substantially co-planar with the floor of the respective base and the second projection may further includes a top wall that is substantially co-planar with the top wall of the respective base. Further, the first and second projections may each include at least one socket adapted to receive one of the poles.

In on embodiment, the fence also includes a first and second connector inserted into the at least one socket of a first projection of a first base of the bases and a second projection of a second base of the bases. In embodiments, the first and second connectors are telescopically engaged and the pole extends into the first and second connectors. Further, each of the first and second projections may have a counterbore dimensioned to accommodate one of the connectors to prevent the one connector from protruding past the bottom or top surface, respectively, of the first and second projections.

A first base of the bases can be selectively positioned with respect to a second base of the bases such that an angle between a longitudinal axis of the first base and a longitudinal axis of the second base is about 30 to about 60 degrees.

DETAILED DESCRIPTION

In general, embodiments of the present invention are directed to a pool fence that is capable of being erected and supported without the need to drill sockets or other openings into a pool deck surrounding a swimming pool or other body of water. As will be described in more detail below, in one embodiment, a system of bases is used to provide support for fence poles and gate poles that can be inserted into sockets in each base to maintain the fence in an upright position. The bases have a relatively low profile and can be filled with a ballast to increase their stability. Further, the bases can be rotatably coupled to each other to allow the fence to extend around any sized or shaped area desired to be fenced and the bases eliminate the need for any fence or gate sockets to be drilled into a pool deck.

In one embodiment, a fence system including fence and gate poles that may be used with embodiments of the bases described here is described in U.S. Pat. No. 5,664,769 ("the '769 patent") to Sadinsky et al., the entire content of which is incorporated herein by reference. However, as will be appreciated, embodiments of the bases may be used with a number of different fence systems and are not limited to those described herein or in the '769 patent. Additionally, the description of embodiments of the present invention sometimes refers to poles as "fence poles" or "gate poles." Although in some cases, the fence poles and gate poles may have a different structure, the fence and gate poles may also have an identical structure, and are identified by "fence" or "gate" based on their location on the fence. For purposes of many embodiments, it will be understood that when referring to the poles, fence poles and gate poles may be used interchangeably and that the sockets of the bases described below can be modified or configured to receive either pole.

Figure 12:
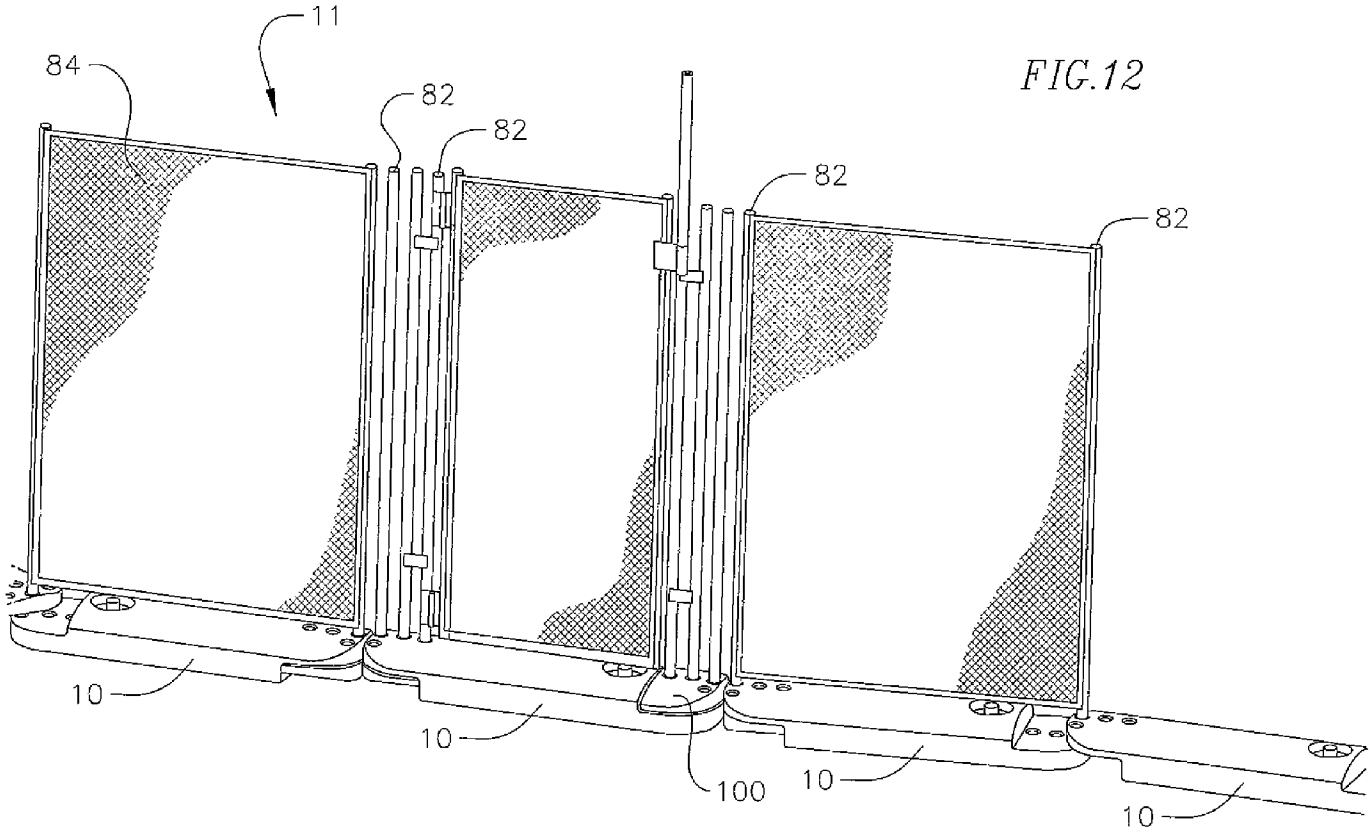
FIG. 12 is a schematic side view of a portion of a fence according to an embodiment of the present invention.

With reference now to FIGS. 1-5, a base 10 is provided that is adapted to receive a pole at each end 82 (FIG. 12). The base 10 includes an opening 12 to allow for the insertion of a ballast and an interior chamber adapted to receive the ballast. As used herein, the term "ballast" is intended to broadly include any materials that can be poured or otherwise inserted into the interior chamber, such as water, salt water, non-freezing fluids, sand, rock, cement, concrete and other similar materials.

The base 10 further includes a body 16 having a floor 18 and a longitudinal axis 20 extending between a first end 22 and an opposing second end 24. The body 16 also includes opposing side walls 26, 28 extending between the floor 18 and atop wall 30. End walls 32, 34 extend between a portion of the side walls 26, 28 at the first end 22 and the second end 24, respectively. Additionally, the base 10 includes a first projection 36 and a second projection 38 projecting outward from the first and second ends 22, 24, respectively, generally along the longitudinal axis 20.

Figures 2, 3, 4, 5:
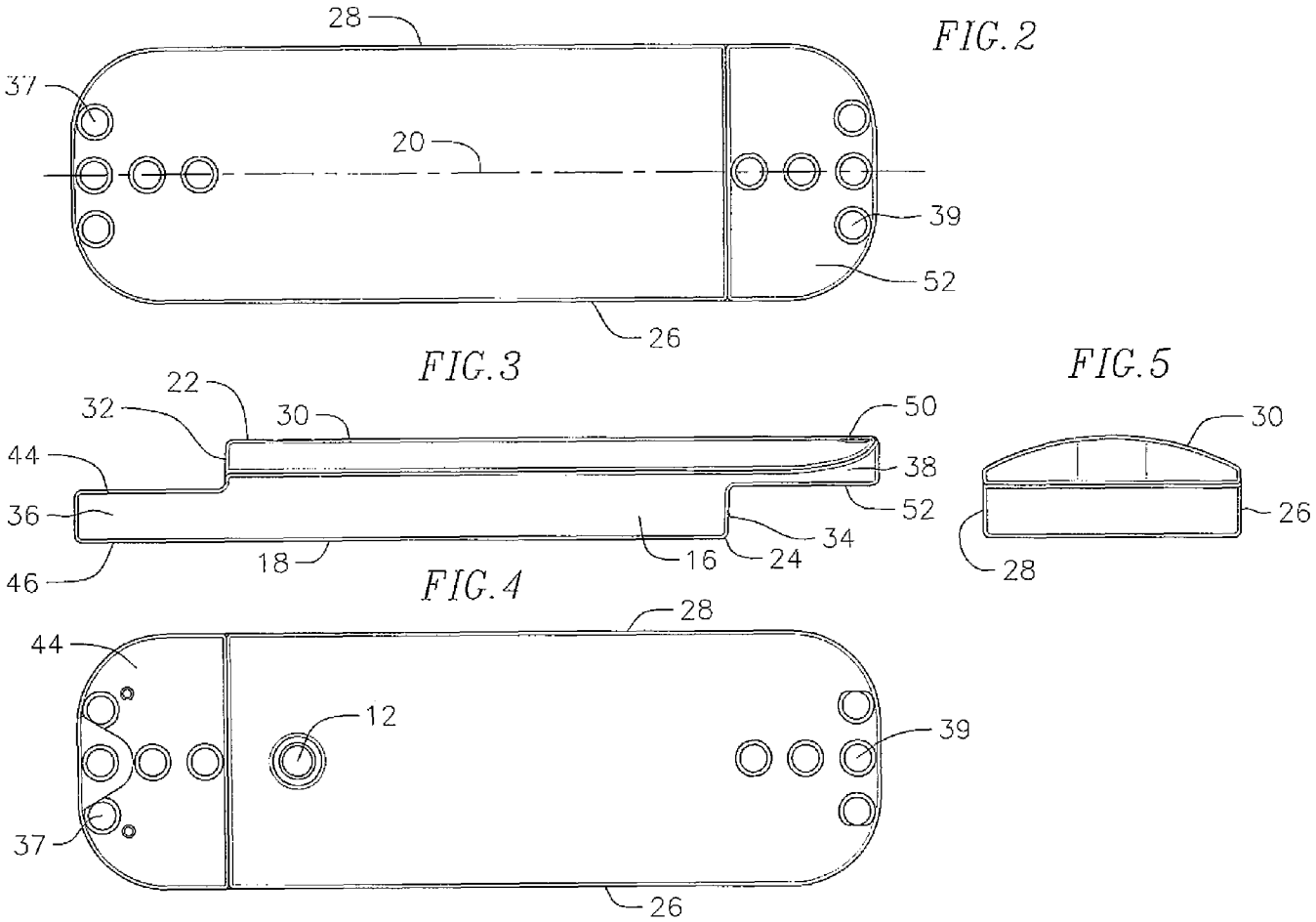

In one embodiment, the side walls 26, 28 of the body 16 are substantially rectangular and are substantially parallel to each other as well as being substantially perpendicular to the floor 18. Additionally, the top wall 30 is generally arc-shaped and thus, the base 10 forms a generally dome-shaped structure when viewed along the longitudinal axis 20 (FIG. 5). It will be appreciated, however, that the base 10 may also be formed in other shapes and is not limited to the shape disclosed herein.

The dimensions of the base 10 may vary, but in one embodiment, a height of the base from the floor 18 to the top of the top wall 30 is between about 3 inches to about 6 inches, a width between opposing side walls 26, 28 of between about 10 inches to about 24 inches, and a length extending from an outer end of the first projection 36 to an outer end of the second projection 38 of between about 30 to about 50 inches. It will be appreciated that the size of the base may be dictated by the size of the fence being used and the size and shape of the area being fenced.

Figure 1:
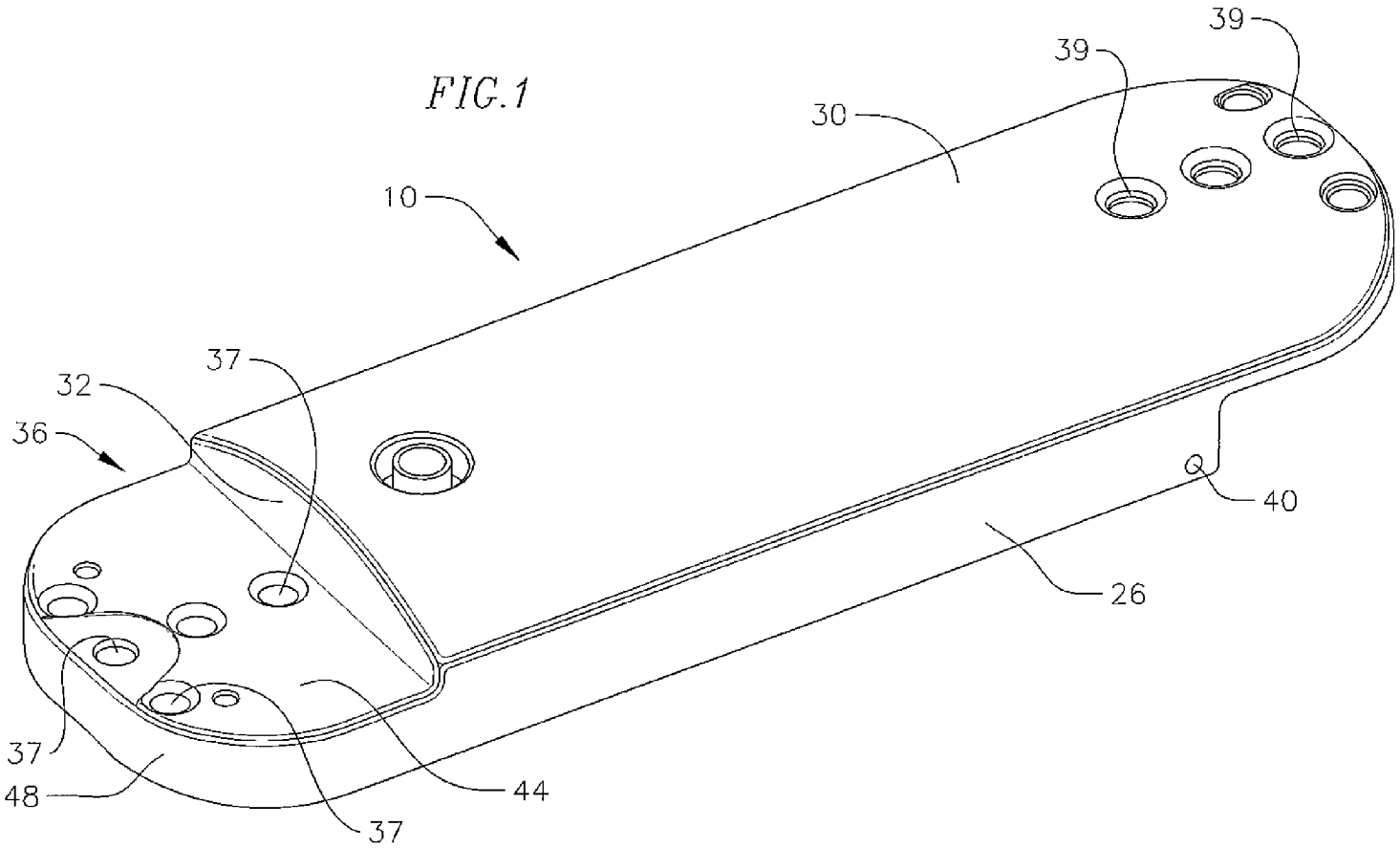
FIGS. 1-5 are a perspective, bottom, side, top, and end view, respectively, of an exemplary base for a pool fence according to an embodiment of the present invention.

As noted above, in one embodiment, the base 10 includes a ballast opening 12 for filling the interior chamber with ballast. As shown in FIGS. 1 and 4, the ballast opening 12 is located on the top wall 30. The opening 12 can be selectively closed or sealed by a cap which may be made from acrylonitrile butadiene styrene (ABS), or any other appropriate material. A threaded insert can be molded, welded, or otherwise attached to the opening 12 to allow the cap to be screwed onto the base 10. It will be appreciated that the ballast opening 12 can be located on any portion of the base 10 or that the opening 12 may be omitted if no separate ballast is required for the base 10.

In one embodiment, the base 10 may also include a drain hole 40 to selectively drain the ballast from the base. The drain hole 40 may extend through either of the side walls 26, 28 and the drain hole may be threaded or otherwise adapted to receive a plug to seal the drain hole. As will be appreciated, the drain hole 40 may be located anywhere on the base 10 that allows ballast to be sufficiently drained therethrough.

As noted above, the base 10 includes a first projection 36 and a second projection 38 projecting generally longitudinally outward from first and second ends 22, 24, respectively, of the body 16. The projections 36, 38 are configured such that for substantially similar bases 10, the first projection 36 of a first base can overlap with the second projection 38 of a second base while the floor 18 of both bases are resting on a common support surface, as discussed in more detail below.

The first projection 36 includes a generally planar top surface 44 and an opposing bottom surface 46 with a perimeter side wall 48 extending therebetween. In one embodiment, the bottom surface 46 lies in the same plane as and is integral with the floor 18 of the body 16, but alternatively, the bottom surface could lie in a different plane than the floor. The top surface 44 extends integrally from the first end wall 32 and is generally parallel to the floor 18. The perimeter side wall 48 is substantially perpendicular to the top and bottom surfaces 44, 46. In one embodiment, the perimeter side wall 48 is semi-decagonal such that at least a portion of the side wall is substantially perpendicular to the side walls 26, 28. However, it will be appreciated that the perimeter side wall 48 may also be other shapes, including other semi-polygons or an arc.

The second projection 38 includes a top surface 50 and an opposing generally planar bottom surface 52 with a perimeter side wall 54 extending therebetween. In one embodiment, the top surface 50 lies in the same plane as and is integral with the top wall 30 of the body 16, but alternatively, the top surface could lie in a different plane than the top wall. The bottom surface 52 extends integrally from the first end wall 32 and is generally parallel to the floor 18. The perimeter side wall 48 is substantially perpendicular to the bottom surface 52. In one embodiment, the perimeter side wall 48 is semi-decagonal such that at least a portion of the side wall is substantially perpendicular to the side walls 26, 28. It will be appreciated that the perimeter side wall 48 may also be other shapes, including other semi-polygons or an arc.

The first and second projections 36, 38 each have a plurality of sockets 37, 39 configured to receive an upper and lower connector 56, 62, as described in more detail below. In one embodiment, as shown in FIG. 1, the first and second projections 36, 38 each have five sockets 37, 39 arranged in substantially a "T" formation. Since the sockets 37, 39 on each projection 36, 38 are substantially the same, only the sockets on the first projection will be described in detail.

Generally, the head of the "T" is defined by three sockets 37 spaced from each other in a direction substantially perpendicular to the longitudinal axis 20. As such, depending on the orientation of the fence, and therefore, the orientation of adjacent bases 10, poles 82 can be inserted into the most appropriate socket 37. For example, if a second base 10 is oriented at an angle to the left of a first base, the leftmost socket 37 can be used.

Additionally, the base of the "T" is formed by two of the sockets 37 that are located at a sufficient distance and orientation to receive two gate poles. Sometimes poles adjacent a gate for the fence are coupled together in close proximity to provide additional support to the gate. Accordingly, the two sockets 37 of the base of the "T" may be oriented to receive the two gate poles (see FIG. 12). As shown in the drawings, the two gate sockets are oriented to be substantially parallel to the longitudinal axis 20 of the base 10. Additionally, although the sockets 37 of the base of the T are meant for "gate" poles, "fence" poles may also be inserted into these sockets. It will be understood that the present invention is not limited to the number and orientation of the sockets as described herein, but rather, it will be appreciated that many different combinations of the number and orientation of sockets may be used.

In one embodiment, each socket 37, 39 extends throughout the respective projection 36, 38 from the top surface to the bottom surface. Additionally, each socket 37, 39 may terminate at one end in a counterbore 68, 70 (FIG. 11) adapted to receive a flange of a connector inserted into the socket. Specifically, the socket 37 in the first projection 36 may terminate in a counterbore 68 at the bottom surface 46 and the socket 39 in the second projection 38 may terminate in a counterbore 70 at the bottom surface 50. Each counterbore 68, 70 may have a depth sufficient to allow the connector 56, 62 to be flush with or recessed from the surface of the first or second projection 36, 38, thereby preventing the connector from interfering with placement of the base.

With reference now to FIGS. 6A, 6B, 7A and 7B, in one embodiment, upper and lower connectors 56, 62 are provided for mechanically engaging the first projection 36 of one base 10 and the second projection 38 of another base to connect the two bases to each other.

Figure 6A:
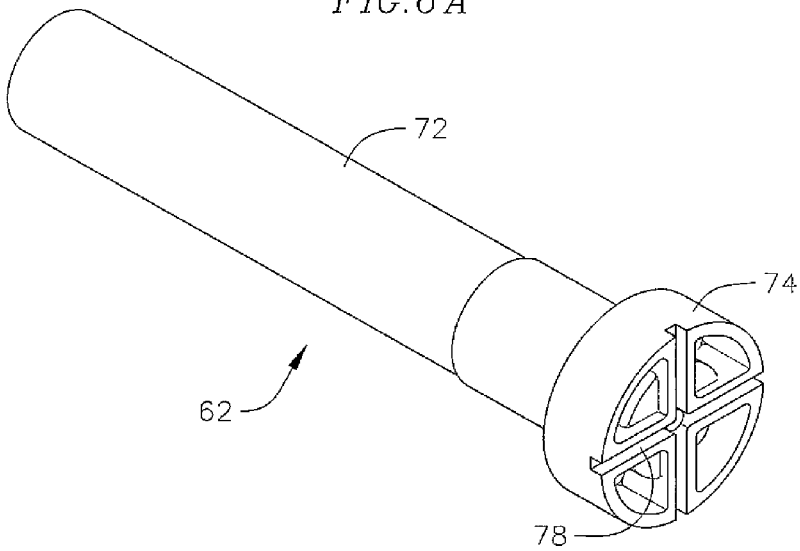
FIGS. 6A and 6B are a perspective and side view, respectively, of an exemplary lower connector for a pool fence according to an embodiment of the present invention.
Figure 6B:
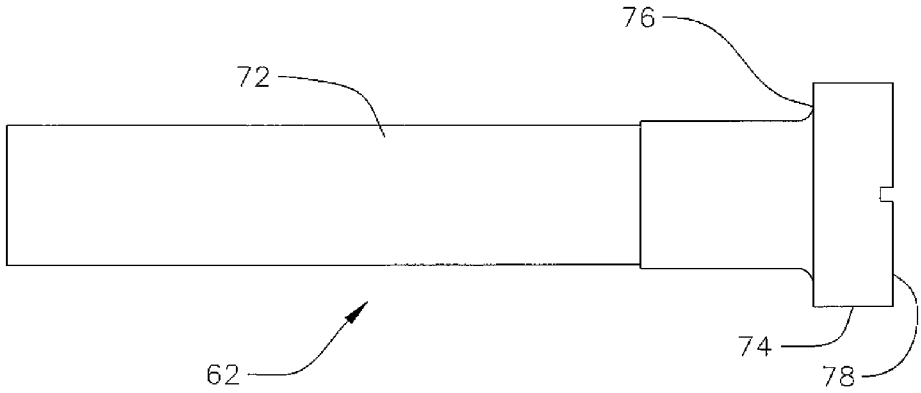
Figure 7A:
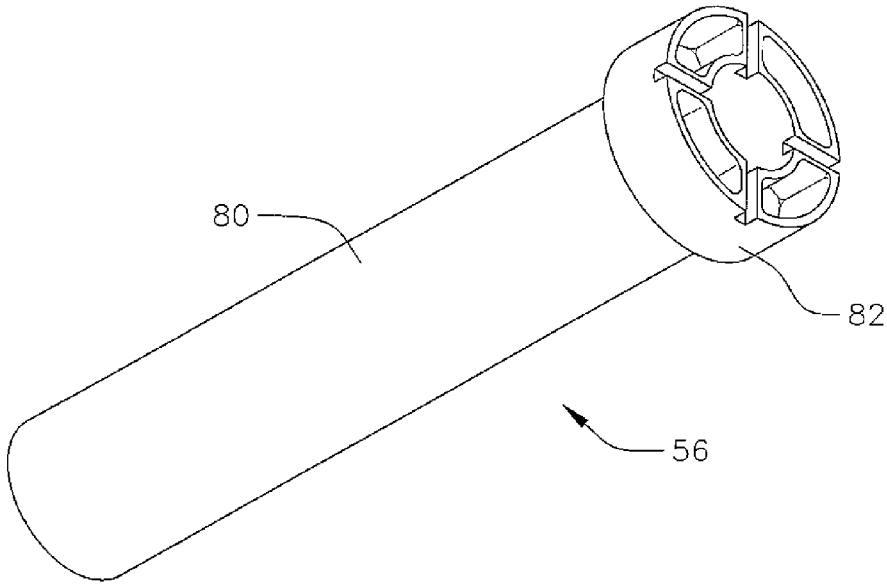
FIGS. 7A and 7B are a perspective and side view, respectively, of an exemplary upper connector for a pool fence according to an embodiment of the present invention.
Figure 7B:
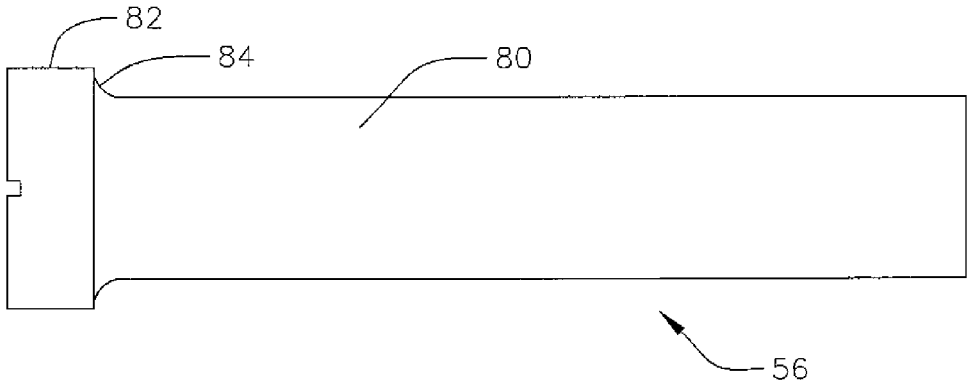

With reference to FIGS. 6A and 6B, a lower connector 62 includes a substantially cylindrical body 72 and a head 74 at one end of the body. In one embodiment, the body 72 is tubular and is adapted to telescopically receive a lower end of a pole 82. Further, the lower connector 62 is sized to be telescopically coupled with the upper connector 56 (FIGS. 7A and 7B). The head 74 is integral with the body 72 and has a diameter greater than a diameter of the body, thereby creating a shoulder 76 configured to abut the counterbore 68 on the first projection 36 when the lower connector 62 is inserted into the socket 37. The head 74 includes an end wall 78 that provides a stop for a pole inserted into the lower connector 62 such that the pole cannot protrude entirely through the connector.

With reference now to FIGS. 7A and 7B, the upper connector 56, similarly to the lower connector 62, includes a substantially cylindrical body 80 and a head 82 having a diameter larger than a diameter of the body to create a shoulder 84 configured to abut the counterbore of the second projection 38. The body 80 is an open-ended tube adapted to receive the lower end of a fence or gate pole 82 and, unlike the lower connector 62, the head 82 is also an open-ended tube, allowing the pin to penetrate through the entire upper connector 56. Additionally, the body 80 is configured to be telescopically coupled with the body 72 of the lower connector 62, as described in more detail below. As will be appreciated, connectors with shapes and sizes other than the described upper and lower connectors may be used for connecting bases 10, or the connectors may be omitted. In one embodiment, the upper and lower connectors 56, 62 are telescopically connected and can be permanently attached together by using, for example, an adhesive.

Figure 8:
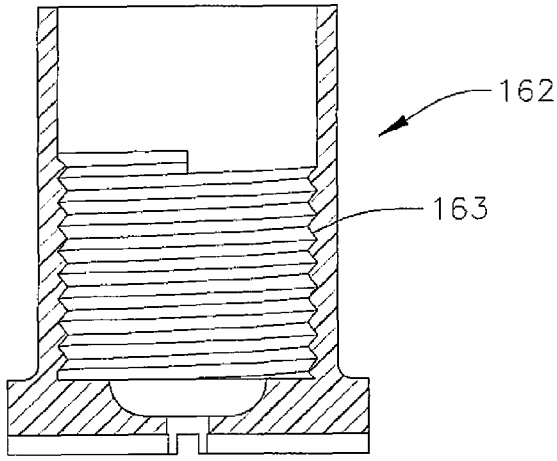
FIG. 8 is a detail view of a portion of an alternate embodiment of a lower connector.
Figure 9:
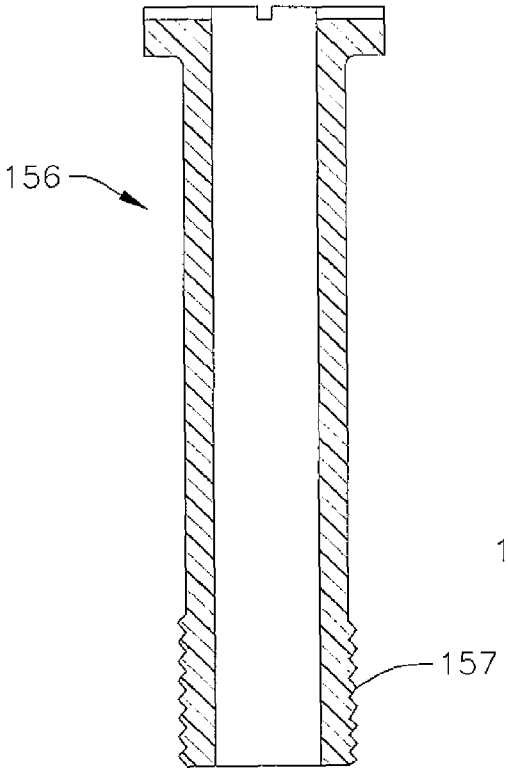
FIG. 9 is a sectional view of an upper connector according to still another alternate embodiment of the present invention.

With reference now to FIGS. 8 and 9, in alternate embodiments, a lower connector 162 has a threaded interior surface 163 configured to receive an upper connector 156 having a threaded exterior surface 157. Accordingly, the upper and lower connectors 156, 162 can be temporarily attached together and then uncoupled as desired.

Figure 10:
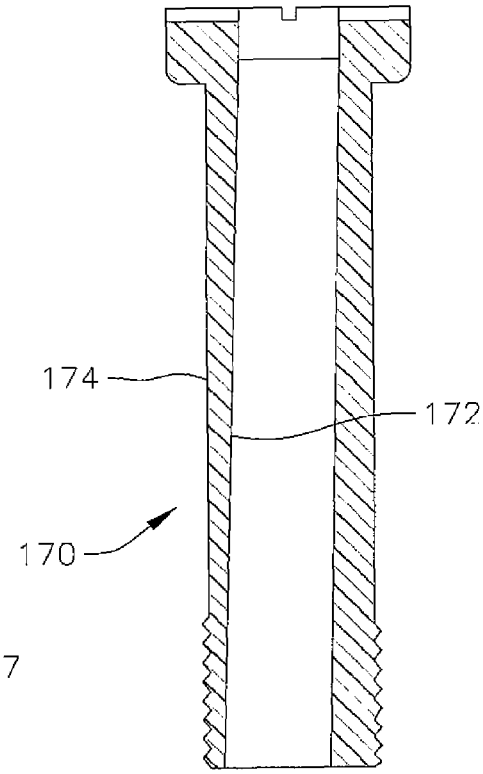
FIG. 10 is a sectional view of an upper connector according to yet another alternate embodiment of the present invention.

With reference now to FIG. 10, another embodiment of a connector 170 is shown. The connector 170 is tubular, but an interior side wall 172 of the connector is angled such that the interior side wall is not parallel to an exterior side wall 173. In one embodiment, the interior side wall 172 extends at an angle between about 1 degree and 5 degrees from the exterior side wall 173. Accordingly, the connector 170 can be used in conjunction with a gate pole, wherein it has been found that extra tension on gate poles may cause them to bend slightly in the direction of the tension. Accordingly, the gate pole may be inserted into the connector 170 oriented so that the pole extends in a direction away from the tension, thereby allowing an upper portion of the gate pole to extend substantially parallel to non-gate poles even under greater tension than those poles.

Figure 11:
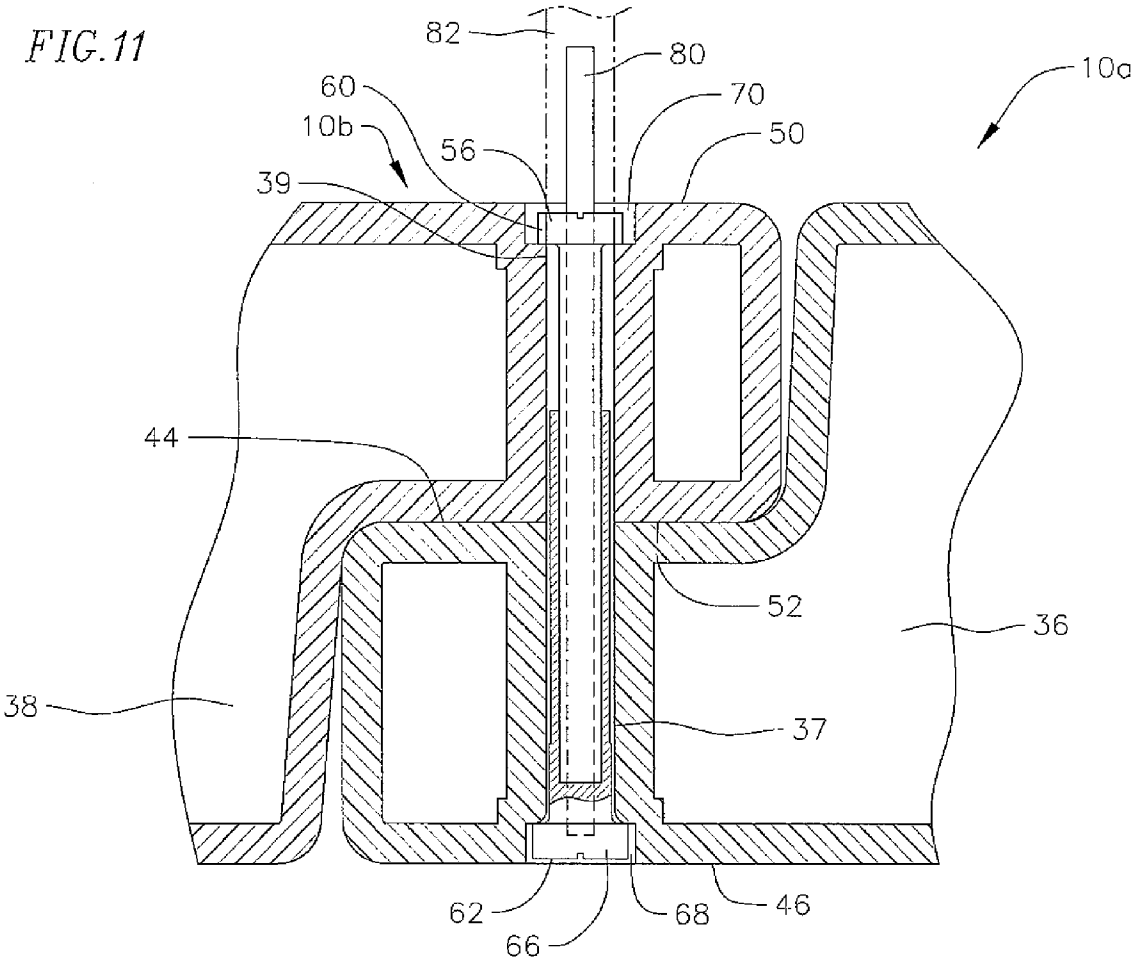
FIG. 11 is a schematic sectional view of two exemplary bases for a pool fence coupled by upper and lower connectors according to an embodiment of the present invention.

With reference now to FIGS. 11 and 12, the first and second projections 36, 28 are configured so that the top surface 44 of the first projection 36 is located in substantially the same plane as the bottom surface 52 of the second projection 38 or below the plane of the bottom surface. As defined herein, the term "below" means a distance or orientation closer to the floor 18. As shown in FIG. 11, because the top surface 44 is either in substantially the same plane as or below the bottom surface 50, the first projection 36 of the first base 10*a* can overlap the second projection 38 of the second base 10*b* while the floor 18 of both bases are resting on a common support surface. The first and second projections 36, 38 are also configured such that for substantially similar bases 10*a*, 10*b*, one of the bases can be selectively positioned relative to the other base over an angle formed between the longitudinal axis 20 of one housing and the longitudinal axis 20 of another housing in a wide range of angles. Since the engaging surfaces 44, 50 are substantially planar, the bases 10, 10*b* can be oriented in an infinite number of relative orientations within the range dictated by the structure of each base. In one embodiment, the range of orientation between two adjacent bases connected by overlapping protrusions is between about 30 and about 60 degrees, but it will be appreciated that the protrusions may be dimensioned to be large enough to allow an orientation of 180 degrees if necessary.

With continued reference to FIG. 11, a connection between two adjacent bases 10*a*, 10*b* will be described according to one embodiment. First, the lower connector 62 is inserted through the socket 37 in the first projection 36 of the first base 10 such that the head 66 of the lower connector 62 abuts the counter bore 68 and is flush with or recessed from the bottom surface 46 of the first projection and such that the body 64 protrudes through the socket.

Then, the second projection 38 of a second base 10*b* is overlapped with the first projection 36 of the first base 10*a* such that the body 64 of the lower connector 62 extends into the socket 39 in the second projection. Once the lower connector 62 has been inserted into the socket 39 in the second projection 38, the upper connector 56 can be inserted into the socket such that the head 60 is within the counter bore 70 on the second projection 38. Since the upper connector 56 is adapted to telescope with the lower connector 62, the body 58 of the upper connector extends into the lower connector and also into the socket 37 in the first projection 36. In this configuration, the two adjacent bases 10*a*, 10*b* are coupled together. It will be appreciated that, depending on the placement of the sockets 37, 39 on the projections 36, 38, when two bases are coupled together, they may rotatable with respect to each other or, for example, if the perimeter side wall 48 abuts the end wall 32, the two bases may be "locked" at a certain angle.

As will be appreciated, since the upper connector 56 has an open-ended head 60, a lower end of the pole 82 can be inserted into the coupled connectors 56, 62 to thereby maintain the pole in an erect or upright position. In some cases, as shown in FIG. 11, the lower end of the pole 82 will be a pin 80 having a diameter smaller than a diameter of the pole 82, thus creating a shoulder. In such a case, the shoulder of the pole 82 can rest on the recessed surface of the counterbore 70 for additional support. In an alternate embodiment, sockets 37, 39 of the first and second projections 36, 38, respectively, could be aligned and the pin 80 of the pole 82 could be inserted directly through the sockets to couple the bases 10, 10' together, thus eliminating the need for the upper and lower connectors 56, 62. Further, it will be appreciated that the sockets 37, 39 could also be sized so that poles without pins could be inserted therein, and that the bases could be customized to accept some poles with pins and some poles without pins. The process of coupling bases and inserting poles can be repeated with as many bases 10 as necessary to encompass the area to be fenced. Further, since each base 10 is configured to support a fence pole or gate poles, the gate can be placed on any of the plurality of the bases.

With reference to FIG. 12, a portion of a fence 11 according to an embodiment of the present invention is illustrated schematically. The fence 11 includes a plurality of bases 10, each base connected to an adjacent base as described above. Although the plurality of bases 10 are shown extending in substantially a straight line, it will be appreciated that the bases could be oriented at an angle from each other, as described herein. The fence further comprises poles 82 inserted into each base 10 and maintained upright by the base and a mesh material 84 tensioned between the poles. As will be appreciated, any suitable material may be used as the "fencing" tensioned between the poles and is not limited to the material described herein.

As described above, a series of bases 10 can be coupled to each other, as described above, to encircle a swimming pool or any other area desired to be fenced. In some cases, only bases 10 may be used, but there may be other occasions, such as when a gate is desired, that an "end insert" is helpful. Accordingly, with reference to FIGS. 12 to 14, an end insert 100 is provided to be positioned on a base 10 such that a height of two adjacent bases 10 of the fence are substantially the same and such that ends of the bases abut, rather than overlap.

Figure 13:
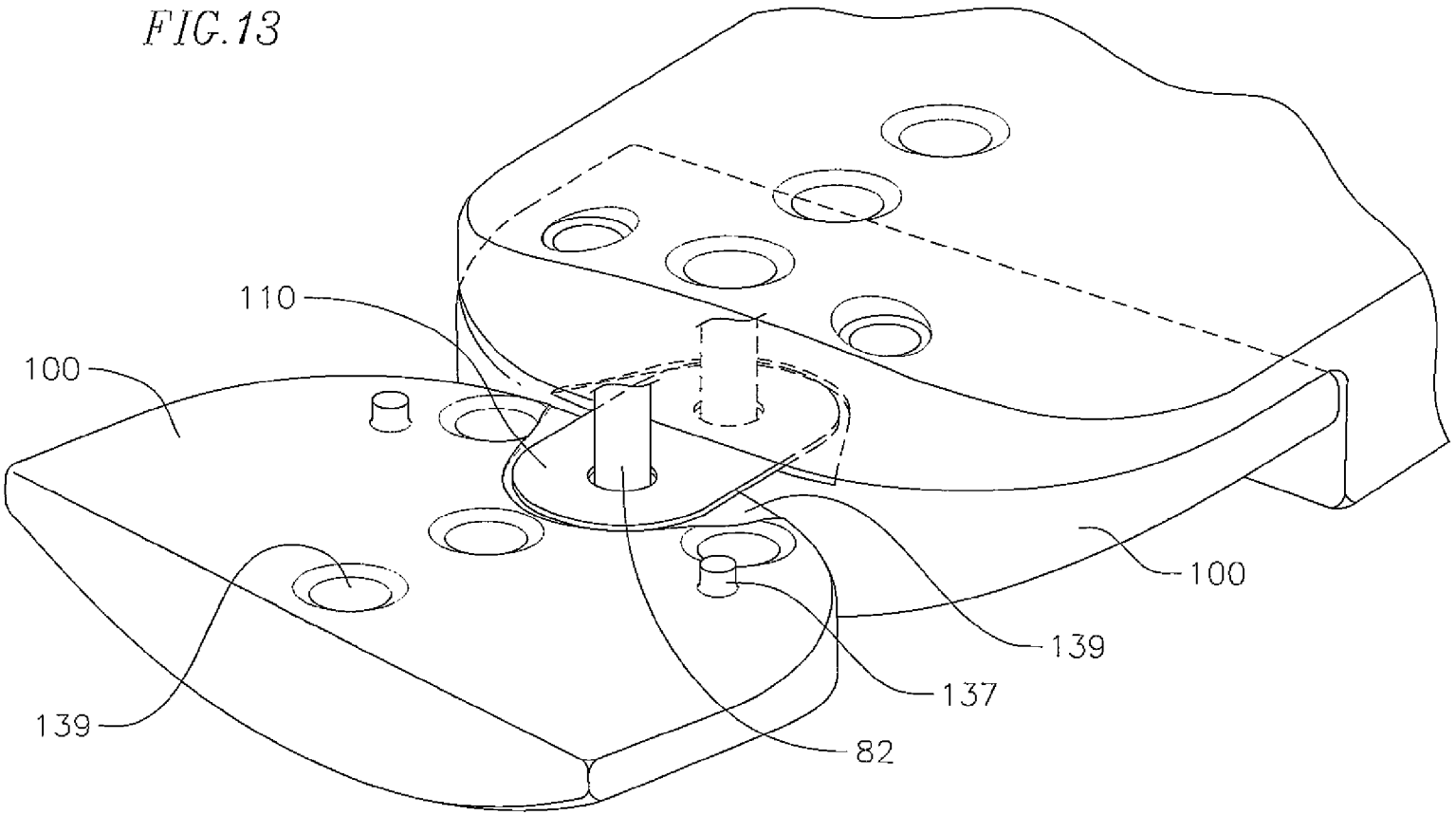
FIG. 13 is a detail cut-away view of two bases of an embodiment of the present invention coupled together by an end plate.

In one embodiment with reference to FIG. 13, the end insert 100 has one rounded or semi-polygonal side 102 and one substantially flat side 104 that can abut the end wall 32, 34 of the base 10 to which it is attached. The end insert 100 has five sockets 139 in the same "T" structure as the base 10, thereby allowing the sockets in the end insert to be aligned with the sockets 39 on the first or second projection 36, 38 of the base. The end insert 100 further includes protrusions 137 that may be inserted into corresponding sockets on the base 10 to attach the end insert to the base. The end insert 100 may be fixed to the base 10 by an interference fit or may be more permanently attached by an adhesive or by any other suitable fastener. As shown in the figures, the end insert 100 is shaped such that surfaces of the end insert are substantially flush with the surfaces of the base 10 to which it is attached and the end insert serves substantially the same function as the first or second projection 36, 38 does when the bases are overlapped. However, using the end insert allows additional sockets 39 of the bases 10 to be adjacent each other, allowing for additional poles that may be required near or on a gate to be inserted into the bases. It will be appreciated that the end insert 100 could have one of a variety of shapes and dimensions and could also include various configurations and numbers of sockets, as necessary.

Figure 14:
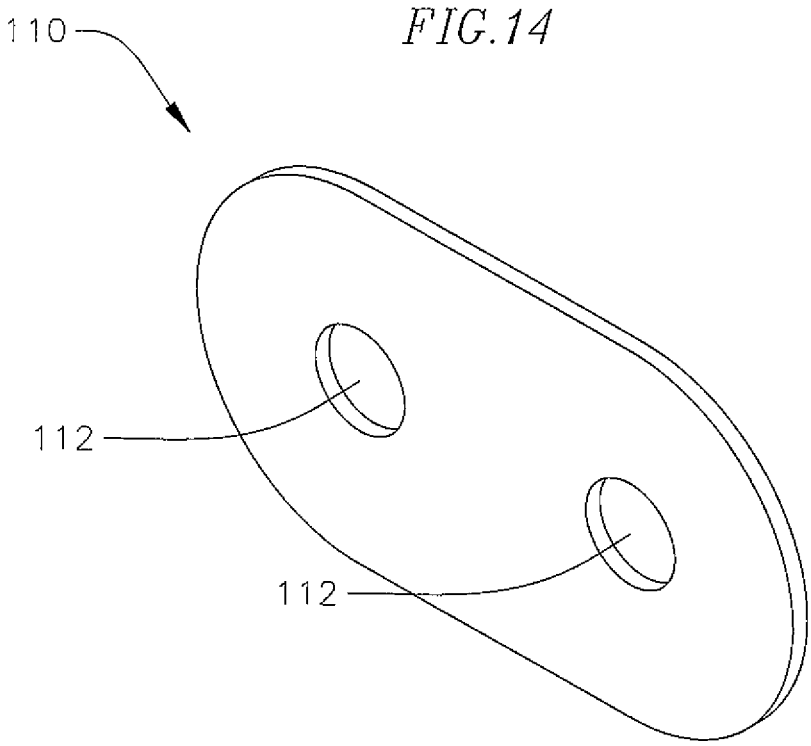
FIG. 14 is a perspective view of an exemplary end plate for a pool fence according to an embodiment of the present invention.

The first projections 36 or second projections 38 of adjacent bases 10 can be abutted and coupled together using an end plate 110, rather than the first projection 36 of a first base 10 overlapping the second projection 38 of a second base 10. With reference to FIGS. 13 and 14, the end plate. 110 is a generally thin ovular plate having a plurality of openings 112. The end plate may be made from metal or a polymer resin, such as nylon containing a 2% carbon black. A thickness of the end plate may be from about 0.050 to about 0.10 inch.

To couple two bases 10 together, the end plate 110 is placed onto the substantially planar surface of the first or second projection 36, 38 of a first base. In one embodiment, the projections 36, 38 may include a recessed area 139 adapted to receive the end plate 110 such that an exterior-facing surface of the end plate is substantially flush with the planar surface of the projection. Then, the end insert 100 can be placed onto the projection, sandwiching the end plate 110 between the projection and the end insert. This process can then be repeated with a second base 10. As shown in FIG. 13, the opening 112 in the end plate 110 can be aligned with the sockets 39, 139 on the projection and end insert to allow a pole 82 and/or a connector therethrough, as described above. When a pole 82 and/or connectors 56, 62 have been inserted through both openings 112 of the end plate 110, the bases 10 will be coupled together.

As will be appreciated, although embodiments of the fence of the present invention have been described with respect to coupling a series of bases 10 together to form a support structure for the fence, the bases will also work sufficiently well if they are not coupled together or if only some of the bases are coupled together.

A method of installing a fence according to an embodiment of the present invention will now be described. Once the area to be fence has been determined, a plurality of bases 10 may be provided to form a perimeter of the fence. As described above, the bases 10 may be overlapped and coupled using the connectors 56, 62. Alternatively, the bases 10 may simply be overlapped without being coupled together or further, abutted with the first projections 36 aligned and the second projections 38 aligned and alternating as such for the length of the fence. Additionally, once the bases 10 are provided and/or coupled, they may still be moved so as to be oriented as desired.

Once the bases 10 are oriented into a desired shape, a ballast, if necessary, may be inserted into the bases to provide additional support to the bases. Poles 82 may then be inserted into the sockets 37, 39 of each base 10 as desired and then fencing material 84 may be tensioned between the poles. It will be understood that, if the fencing material 84 is already coupled to each pole 82, the poles could be inserted into the bases and the bases could be moved to provide the appropriate tension to the fencing material. As noted above, since each base 10 is adapted to receive gate poles as well as fence poles, a gate can be installed at any location on the fence, and projections of bases may be abutted rather than overlapped to accommodate the gate and gate poles, as necessary.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A fence comprising:

a plurality of bases, each base comprising:

a body having a floor, a top wall, side walls and end walls defining an interior chamber;

a first projection extending from one of the end walls and having a top wall; and a second projection extending from another one of the end walls and having a bottom wall; wherein the first projection and the second projection each have a socket extending entirely therethrough and a counterbore defined at an end of each socket, and wherein the first projection of a first base of the bases overlaps and contacts the second projection of a second base of the bases when the floor of the first and second bases are resting on a common surface;

a first connector at least partially accommodated within a counterbore of the socket of the first projection and extending into the socket of the second projection;

a second connector at least partially accommodated within a counterbore of the socket of the second projection and extending into the socket of the first projection;

a plurality of poles, each pole accommodated within the socket of the first projection and/or the socket of the second projection; and a fencing material tensioned between the plurality of poles.

2. The fence of claim 1, wherein the bottom wall of the second projection and the top wall of the first projection are substantially co-planar.

3. The fence of claim 1, wherein the first projection further includes a bottom wall that is substantially co-planar with the floor of the respective base.

4. The fence of claim 1, wherein the second projection further includes a top wall that is substantially co-planar with the top wall of the respective base.

5. The fence of claim 1, wherein the first and second connectors each have an open end and a closed end comprising an end wall, wherein each of the connectors extends through the first base and through the second base such that the end wall is flush with or recessed from the floor of both of the first and second bases.

6. The fence of claim 1, wherein the first and second connectors are telescopically engaged.

7. The fence of claim 1, wherein the pole extends into the first and second connectors.

8. The fence of claim 1, wherein each counterbore is dimensioned to accommodate one of the connectors to prevent the first and second connectors from protruding past the bottom or top surface, respectively, of the first and second projections.

9. The fence of claim 1, wherein the first and second connectors have a substantially tubular body and a head having a diameter greater than the tubular body.

10. The fence of claim 1, wherein the first base can be selectively positioned with respect to the second base such that an angle between a longitudinal axis of the first base and a longitudinal axis of the second base is between about 30 to about 60 degrees.

11. The fence of claim 1, wherein each base further includes an opening configured to allow insertion of a ballast into the interior chamber.

12. The fence of claim 1, further comprising an end plate extending between adjacent bases to couple the bases together.

* * * * *